US008914916B2

(12) United States Patent
Castillo

(10) Patent No.: US 8,914,916 B2
(45) **Date of Patent: *Dec. 23, 2014**

(54) HELMET SUSPENSION SYSTEM

(71) Applicant: James D. Castillo, Los Alamos, CA (US)

(72) Inventor: James D. Castillo, Los Alamos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/064,361

(22) Filed: Oct. 28, 2013

(65) Prior Publication Data

US 2014/0047622 A1 Feb. 20, 2014

Related U.S. Application Data

(63) Continuation of application No. 13/474,390, filed on May 17, 2012, now Pat. No. 8,590,064.

(51) Int. Cl.

| | |
|---|---|
| ***A42B 7/00*** | (2006.01) |
| ***A42B 3/08*** | (2006.01) |
| ***A42B 3/04*** | (2006.01) |

(52) U.S. Cl.

CPC ..... *A42B 3/08* (2013.01); *A42B 3/0473* (2013.01)

USPC ..... 2/421; 2/411; 2/425

(58) Field of Classification Search

USPC ..... 2/410, 411, 413, 421, 422, 424, 425; 602/17; 128/97.1, 857

See application file for complete search history.

(56) References Cited

U.S. PATENT DOCUMENTS

| | | | | |
|---|---|---|---|---|
| 3,072,118 | A * | 1/1963 | Standerwick et al. | 602/17 |
| 3,134,106 | A * | 5/1964 | Shaffer et al. | 2/462 |
| 3,387,304 | A | 6/1968 | Simpson et al. | |
| 3,487,417 | A | 12/1969 | Morgan | |
| 3,534,408 | A * | 10/1970 | Fifield | 2/2.17 |
| 3,864,756 | A | 2/1975 | Desimone | |
| 4,024,738 | A | 5/1977 | Pi | |
| 4,270,679 | A | 6/1981 | Gildea et al. | |
| 4,664,341 | A * | 5/1987 | Cummings | 244/122 AG |
| 4,825,476 | A * | 5/1989 | Andrews | 2/461 |
| 5,195,947 | A * | 3/1993 | Bode | 602/18 |
| 5,313,670 | A * | 5/1994 | Archer, III | 2/411 |
| 5,517,699 | A * | 5/1996 | Abraham, II | 2/425 |
| 5,546,601 | A * | 8/1996 | Abeyta | 2/468 |
| 5,581,816 | A * | 12/1996 | Davis | 2/416 |
| 5,624,387 | A * | 4/1997 | McGuinness | 602/18 |
| 5,697,894 | A * | 12/1997 | Gullichsen et al. | 602/32 |
| 5,930,843 | A * | 8/1999 | Kelly | 2/468 |
| 6,253,389 | B1 * | 7/2001 | Scaglione | 2/456 |
| 6,351,854 | B1 | 3/2002 | Whalen et al. | |
| 6,560,789 | B2 | 5/2003 | Whalen et al. | |
| 6,591,430 | B1 * | 7/2003 | Sledge | 2/468 |
| 6,659,972 | B2 * | 12/2003 | Stamper et al. | 602/17 |

(Continued)

OTHER PUBLICATIONS

International Search Report and Written Opinion of International Application No. PCT/US2013.040767; 7 Pages.

*Primary Examiner* — Katherine Moran

*Assistant Examiner* — Megan Brandon

(74) *Attorney, Agent, or Firm* — Stetina Brunda Garred & Brucker

(57) ABSTRACT

Provided is a helmet suspension system which is configured to mitigate rapid movements, i.e., acceleration and deceleration, of a user's head. The helmet suspension system connects to a base and a helmet worn by a wearer and allows for slow, safe movements of the helmet relative to the base, but restricts rapid and generally unsafe movements of the helmet relative to the base.

9 Claims, 5 Drawing Sheets

(56) References Cited

U.S. PATENT DOCUMENTS

| | | | | |
|---|---|---|---|---|
| 6,729,643 | B1 * | 5/2004 | Bassick et al. | 280/730.1 |
| 6,968,576 | B2 * | 11/2005 | McNeil et al. | 2/425 |
| 7,124,449 | B2 | 10/2006 | Sutter et al. | |
| 7,153,283 | B1 | 12/2006 | Triolo et al. | |
| 7,371,221 | B1 * | 5/2008 | Baker | 602/18 |
| 7,395,558 | B2 * | 7/2008 | Mothaffar | 2/421 |
| 7,404,402 | B2 * | 7/2008 | Yu | 128/857 |
| 7,430,767 | B2 * | 10/2008 | Nagely | 2/425 |
| 8,038,635 | B2 * | 10/2011 | Dellanno | 602/18 |
| 8,057,415 | B2 * | 11/2011 | Hipp et al. | 602/18 |
| 8,181,281 | B2 * | 5/2012 | Nagely et al. | 2/425 |
| 8,257,292 | B2 * | 9/2012 | Linares | 602/18 |
| 8,484,768 | B2 * | 7/2013 | Leatt et al. | 2/468 |
| 2003/0037669 | A1 | 2/2003 | Alcorn | |
| 2003/0088906 | A1 | 5/2003 | Baker | |
| 2004/0082892 | A1 * | 4/2004 | Stamper et al. | 602/17 |
| 2004/0194194 | A1 * | 10/2004 | McNeil et al. | 2/421 |
| 2004/0255368 | A1 * | 12/2004 | Baker | 2/410 |
| 2005/0204457 | A1 * | 9/2005 | Stiles et al. | 2/425 |
| 2006/0192361 | A1 * | 8/2006 | Anderson et al. | 280/124.158 |
| 2007/0157371 | A1 * | 7/2007 | Nagely | 2/410 |
| 2007/0245464 | A1 * | 10/2007 | Baker | 2/411 |
| 2008/0209617 | A1 * | 9/2008 | Castillo | 2/461 |
| 2008/0256684 | A1 * | 10/2008 | Ashline | 2/411 |
| 2008/0313791 | A1 * | 12/2008 | Nagely | 2/425 |
| 2009/0158509 | A1 * | 6/2009 | Ghajar | 2/422 |
| 2010/0204628 | A1 * | 8/2010 | Ghajar | 602/18 |
| 2010/0263110 | A1 * | 10/2010 | Berry | 2/459 |
| 2010/0298748 | A1 * | 11/2010 | Rosenfeld et al. | 602/17 |
| 2011/0004980 | A1 * | 1/2011 | Leatt et al. | 2/424 |
| 2012/0304366 | A1 * | 12/2012 | Daoust | 2/411 |
| 2013/0185854 | A1 * | 7/2013 | Bonomelli | 2/468 |

* cited by examiner

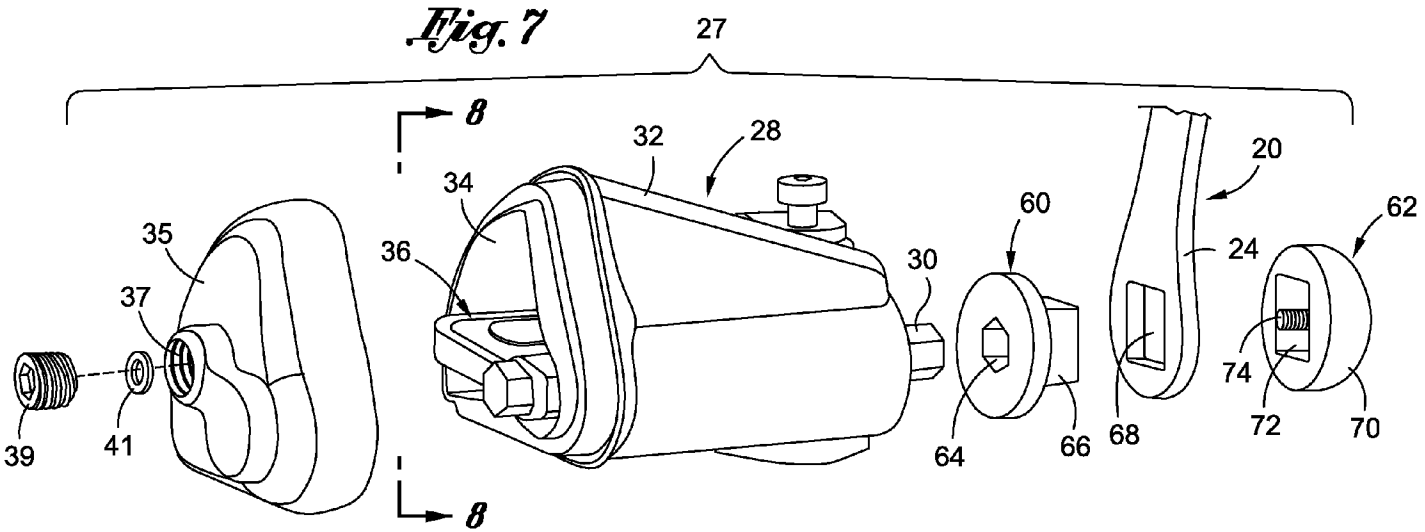
Fig. 7
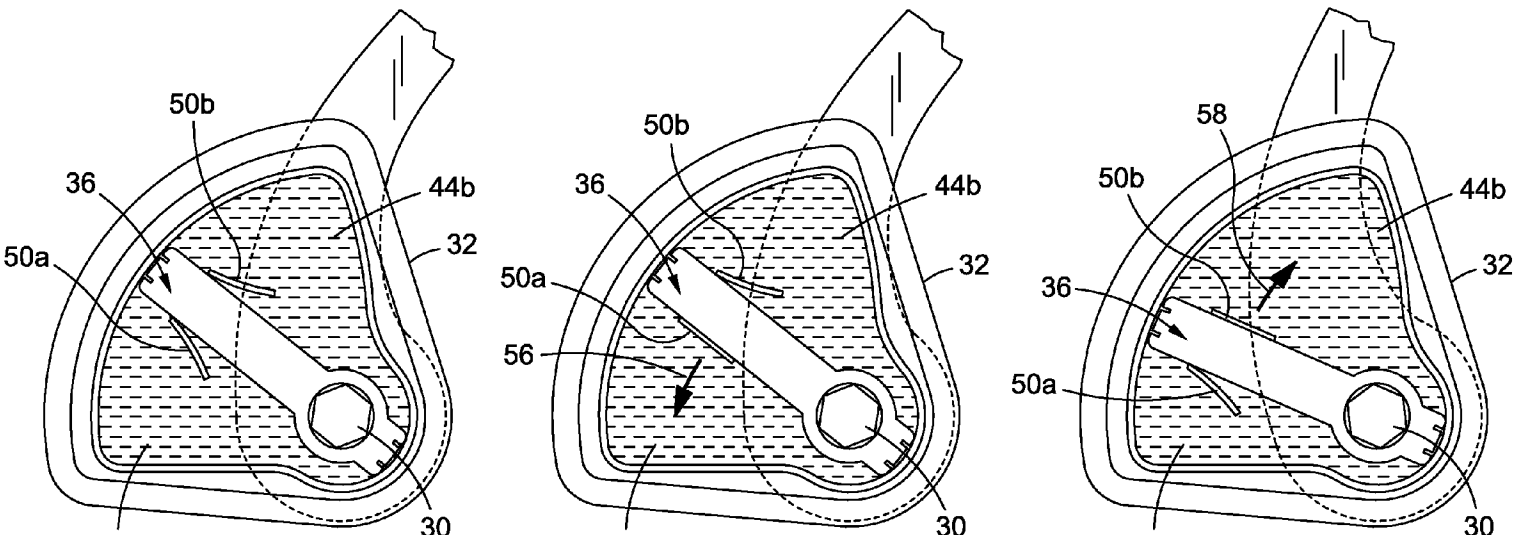
Fig. 10
Fig. 9
Fig. 8

HELMET SUSPENSION SYSTEM

CROSS-REFERENCE TO RELATED APPLICATIONS

The present application is a continuation patent application of U.S. patent application Ser. No. 13/474,390 filed on May 17, 2012 the entire contents of which are incorporated herein by reference.

STATEMENT RE: FEDERALLY SPONSORED RESEARCH/DEVELOPMENT (Not Applicable)

BACKGROUND OF THE INVENTION

1. Field of the Invention

The present invention relates generally to a suspension system and more specifically to a suspension system for a helmet to restrict quick and rapid movements thereof.

2. Description of the Related Art

It is well known that motor sports have developed over the years to achieve worldwide interest. Motor sports may generally refer to that genus of sports which utilizes motorized vehicles, typically for racing competition. Exemplary motor sports include, but are not limited to, motorcycle racing, auto racing, boat racing, air racing, and snowmobile racing. During racing competition, individuals typically operate the motorized vehicles at high rates of speed, which is thrilling for the participants, as well as for spectators.

The high speeds associated with most motor sports, which accounts for much of the thrill connected with motor sports, also present safety concerns for the drivers. Along these lines, during an accident, the motorized vehicle may impact a barrier, wall or another vehicle, which may cause rapid deceleration. During the rapid deceleration, the participant's body is susceptible to injury. Therefore, restraint systems have been developed to restrain the participant's body in the event of a crash.

It is also well-known for drivers to wear protective helmets when operating motorized vehicles to protect their heads in the event of a crash. The helmet typically includes a hard outer surface and a padded inner surface to soften the impact on a driver's head. Although the restraint and helmet systems offer significant safety benefits to a driver, the helmet typically remains susceptible to significant accelerations/decelerations in the event of an accident.

Therefore, there is a need in the art for a safety device which mitigates the rapid movement of a protective helmet. The present invention addresses this particular need, as will be discussed in more detail below.

BRIEF SUMMARY OF THE INVENTION

According to an aspect of the present invention, there is provided a helmet suspension system which is configured to mitigate rapid movements, i.e., acceleration and deceleration, of a user's head. The helmet suspension system connects to a base and a helmet worn by a wearer and allows for slow, safe movements of the helmet relative to the base, but restricts rapid and generally unsafe movements of the helmet relative to the base.

According to one embodiment, the helmet suspension system includes a track housing connectable to the helmet and defining a track channel. A first track insert is disposed within and moveable within the track channel. The helmet suspension system further includes a first arm having a first end portion and a second end portion. The first end portion is connected to the first track insert and the first arm being moveable relative to the track housing as the first track insert moves within the track channel. A first damper is moveably connected to the second end portion of the first arm and is configured to define an acceleration threshold of the second end portion relative to the first damper. The first damper allows movement of the first arm relative to the first damper when the motion of the first arm is below the acceleration threshold and restricts movement of the first arm relative to the first damper when the motion is above the acceleration threshold.

The first damper may include a damper housing defining an inner chamber and a flapper disposed within and moveable within the inner chamber. The flapper may divide the inner chamber into a first chamber portion and a second chamber portion. The flapper may further define a flapper opening through which the first and second chamber portions are fluidly connectable. The first damper may additionally include a valve connected to the flapper to control fluid communication between the first and second chamber portions via the flapper opening. The valve may be moveable relative to the flapper between an open position, wherein the valve is positioned to allow fluid flow through the flapper opening between the first and second chambers and a closed position wherein the valve substantially blocks fluid flow through the flapper opening between the first and second chamber portions. The valve may be biased toward the open position.

The helmet suspension system may additionally include a second arm connected to a second damper and a second track insert, a third arm connected to a third damper and a third track insert, and a fourth arm connected to a fourth damper and a fourth track insert.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings in which like numbers refer to like parts throughout and in which:

FIG. 7 is an exploded view of a damping element;

FIG. 8 side sectional view of the damping element wherein the first and second valves are both in the open position to allow pivotal movement of the flapper within the housing;

FIG. 9 is a side sectional view of a damping element wherein a first valve is closed to restrict movement of a flapper in a first direction;

FIG. 10 is a side sectional view of the damping element wherein a second valve is closed to restrict movement of the flapper in a second direction;

Common reference numerals are used throughout the drawings and detailed description to indicate like elements.

DETAILED DESCRIPTION OF THE INVENTION

Figure 1:
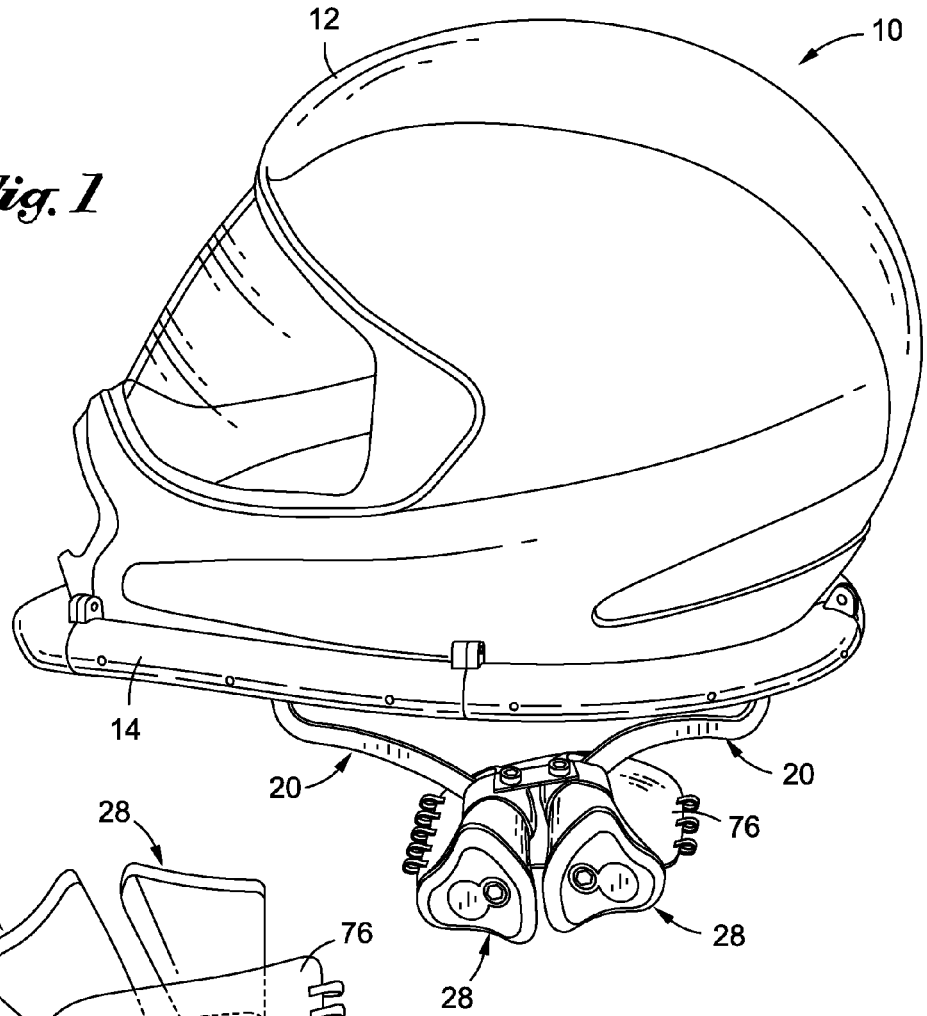
FIG. 1 is an upper perspective view of an embodiment of a helmet suspension system connected to a helmet.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Referring now to the drawings, wherein the showings are for purposes of illustrating preferred embodiments of the present invention, and are not for purposes of limiting the same, there is depicted a helmet suspension system 10 constructed in accordance with an embodiment of the present invention. The helmet suspension system 10 employs an innovative motion dampening mechanism configured to protect a wearer's head from violent movements. More specifically, the innovative motion dampening mechanism allows the wearer to slowly move the helmet 12 in safe, controlled movements up and down, as well as side-to-side. However, the motion dampening mechanism is configured to substantially restrict rapid movements of the helmet 12 (i.e., prevent rapid accelerations of the helmet 12).

FIG. 1 is an upper perspective view showing the suspension system 10 integrated with the helmet 12. The helmet 12 may be any helmet 12 or protective device used for protecting a wearer's head, particularly during motorsports, such as auto-racing, motorcycle racing, snowmobile racing, boat racing, piloting, etc., although it is contemplated that the suspension system 10 may be integrated into helmets used in football, hockey, lacrosse, bicycling, and other sports known by those skilled in the art. A track housing 14 is connected to the helmet 12 and preferably conforms to the external contour of the helmet 12 and extends around the periphery of a lower end portion of the helmet 12 (i.e., adjacent the opening of the helmet 12 through which the user inserts his head to wear the helmet 12). The track housing 14 may be attached to the helmet 12 via nails, rivets, adhesives or other mechanical fasteners known in the art, or alternatively, the track housing may be integrally formed into the body of the helmet 12. In this regard, the track housing 14 may be retro-fit onto an existing helmet 12 or integrated into the design of a newly manufactured helmet 12.

According to one embodiment, the track housing 14 is generally C-shaped and defines an inner track channel 16. A track insert 18 is disposed within the track channel 16 and is configured to move within the channel 16 as the wearer moves his head while wearing the helmet 12. The track housing 14 serves as a "guide" which allows for movement of the first track insert 18 along a fixed track. In this regard, the track insert 18 may translate, pivot, or rotate within the channel 16.

The track insert 18 is preferably captured within the channel 16 to remain within the channel 16 during use of the helmet 12. Thus, the channel 16 and first track insert 18 are sized and configured to withstand large forces which may be generated during usage of the helmet 12, as described in more detail below.

The track insert 18 is connected to an arm 20 which includes a first end portion 22 and a second end portion 24, with the first end portion 22 being connected to the track insert 18. According to one embodiment, the first end portion 22 defines a rounded segment having an aperture 21 extending therethrough to facilitate connection to the track insert 18 (see FIG. 3). The track insert 18 may also be comprised of two insert portions 18*a*, 18*b*, which collectively define the track insert 18. Each insert portion 18*a*, 18*b*, includes a respective aperture 23*a*, 23*b* which are coaxially aligned with the aperture 21 formed within the arm 20 and a mechanical fastener 25 may be inserted through the apertures 21, 23*a*, 23*b* to connect the arm 20 to the insert portions 18*a*, 18*b*.

Figure 2:
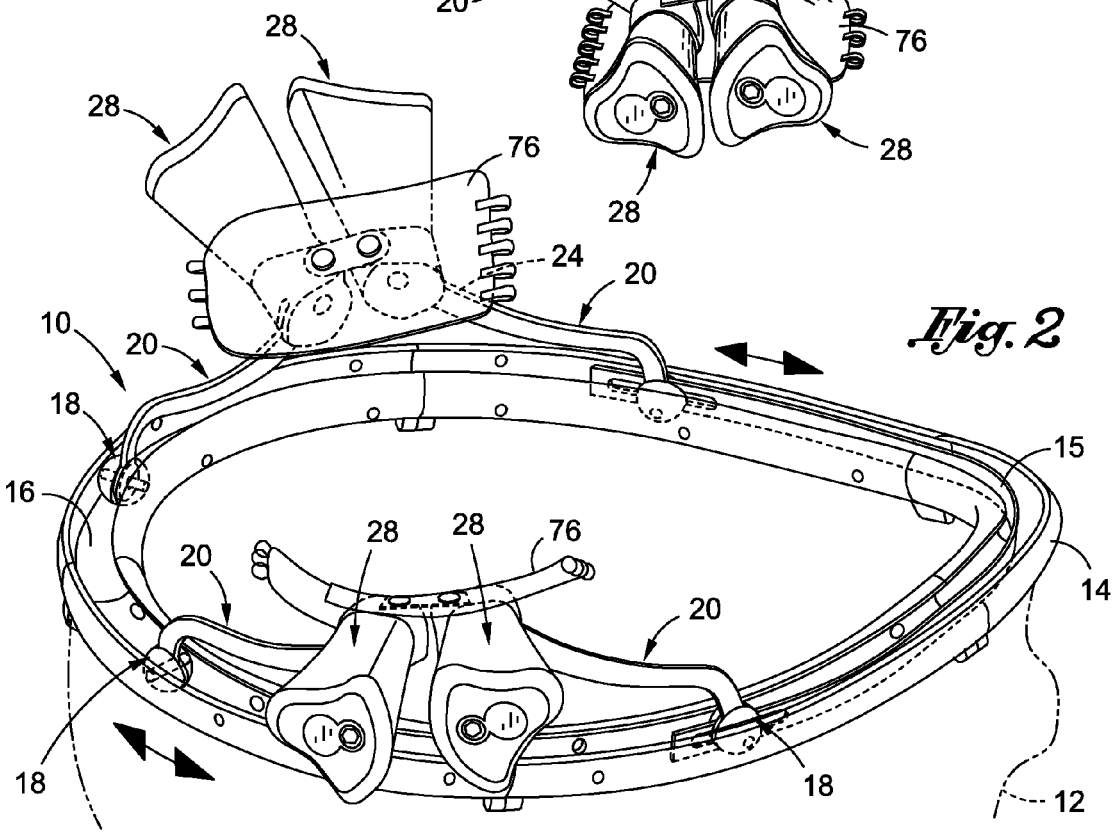
FIG. 2 is an upper perspective view of the helmet suspension system shown in FIG. 1, wherein the helmet suspension system has been inverted relative to its orientation in FIG. 1 and the helmet is shown in phantom.
Figure 3:
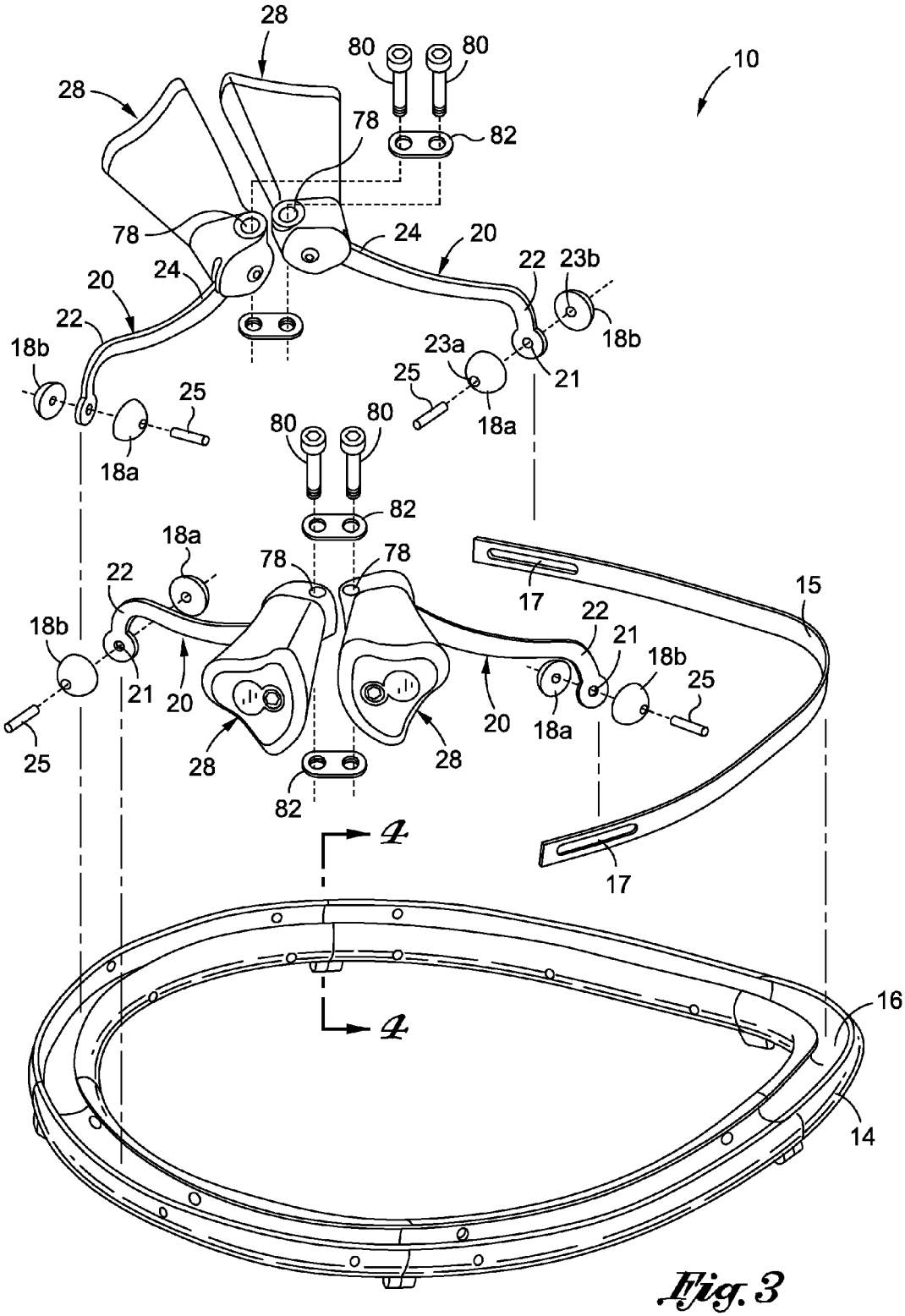
FIG. 3 is an exploded upper perspective view of the helmet suspension system shown in FIG. 2.

According to one embodiment, the track insert 18 is connected to a restriction member or stopper 15, which may be rigid and include one or more restriction channels 17 formed therein to restrict the freedom of movement of the track insert 18 within the track channel 16. The track insert 18 may be connected to the restriction member 15 by aligning the apertures 21, 23*a*, 23*b* with a restriction channel 17 and inserting the mechanical fastener 25 therethrough. Those skilled in the art will appreciate that although FIGS. 2-3 show only one restriction member 15, it is contemplated that more than one restriction member 15 may be employed to connect with all of the track inserts 18 of a helmet suspension system 10.

Figure 4:
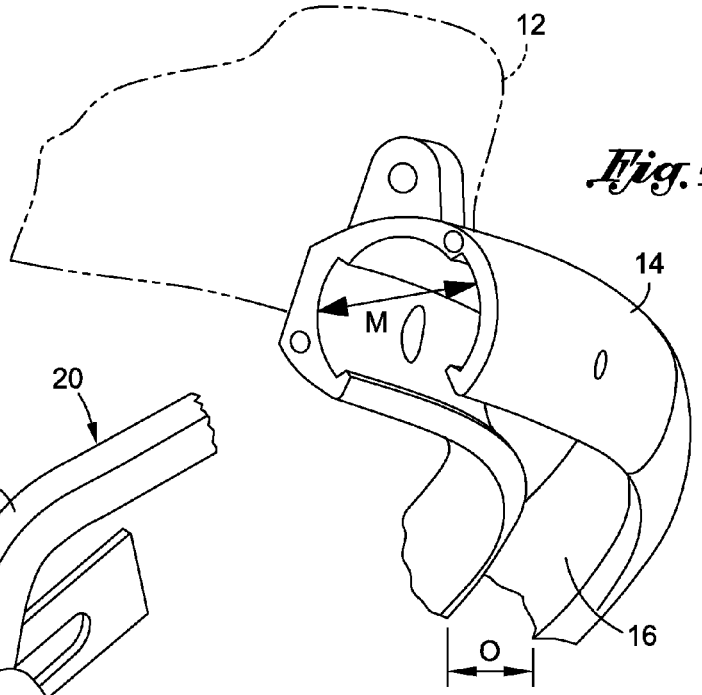
FIG. 4 is a partial lower perspective view of a guide which is connectable adjacent a lower rim of the helmet.
Figure 5:
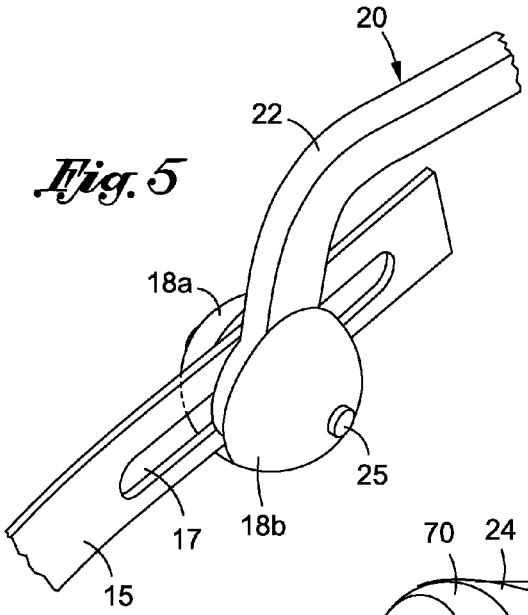
FIG. 5 is a partial upper perspective view of a support arm connected to a motion restriction member which is insertable within the guide.
Figure 6:
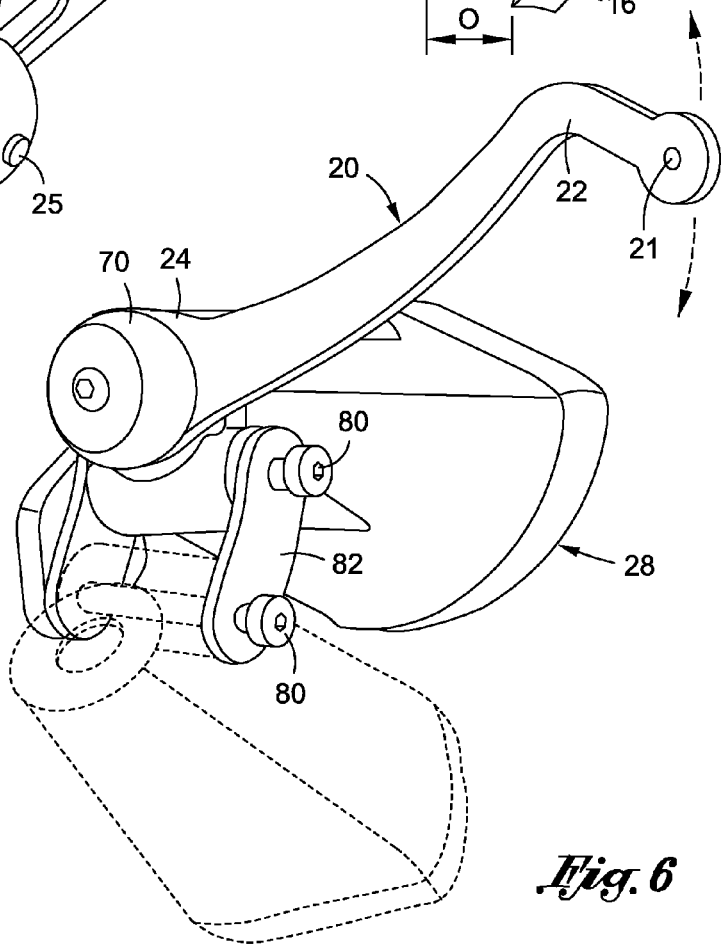
FIG. 6 is an upper perspective view of a first damping element and a first support arm pivotally connected to each other, and a second damping element shown in phantom.

The channel 16 may be configured to define an opening width, "O" (see FIG. 4) and a maximum inner width, "M" to allow the insert 18 to easily move within the channel 16, while at the same time maintaining the insert 18 therein. The insert 18 may define a diameter or outer dimension that is larger than the opening width O and smaller than the maximum inner width M to allow the insert 18 to remain in the channel 16. Furthermore, the axle 26 may define a length that is also longer than the opening width O and smaller than the maximum inner width M to capture the axle 26 within the channel 16.

The insert 18 and first end portion 22 of the arm 20 may be placed within the channel 16 during construction or assembly of the system 10. Along these lines, the track housing 14 may be comprised of several pieces or sections which are connected to each other during assembly. The insert 18 and arm 20 may be disposed within the channel 16 during the assembly of the track housing 14.

As will be described in more detail below, the second end portion 24 of the arm 20 may be connected to a substantially stationary surface. Therefore, as the helmet 12 is moved in response to movements of the wearer's head, arm 20 pivots and the insert 18 moves along the track channel 16.

Referring now to FIG. 7, there is shown a damper assembly 27, which includes the arm 20 and a damping mechanism 28 connected to the second end portion 24 of the arm 20. The second end portion 24 of the first arm 20 is connected to a shaft 30 (see FIGS. 7-10) that is rotatable within the damping mechanism 28 as the arm 20 pivots during movement of the insert 18 within the channel 16. The damping mechanism 28 is configured to restrict quick rotational of the shaft 30, while allowing slow rotations of the shaft 30.

Figure 11:
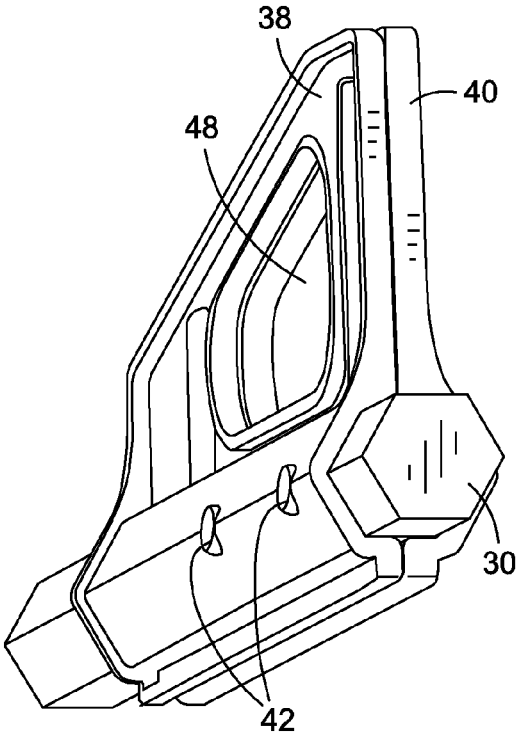
FIG. 11 is a lower perspective view of a flapper element.

The damping mechanism 28 includes a damper housing 32 and a damper cap 35 collectively defining an inner chamber 34. A flapper 36 is connected to the shaft 30 and is moveable within the inner chamber 34. The flapper 36 may be of two-piece construction and include a first flapper body 38 and a second flapper body 40 that are connected to each other and the shaft 30, as shown in FIG. 11. The first and second flapper bodies 38, 40 may be connected to the shaft 30 by a pair of mechanical fasteners 42 which are inserted through holes formed within the first and second flapper bodies 38, 40 and the shaft 30.

Referring now specifically to FIGS. 8-10, the flapper 36 divides the inner chamber 34 into first and second chamber portions 44*a*, 44*b*. In this regard, the outer periphery of the flapper 36 is substantially complimentary to the cross-sectional shape of the damper housing 32. The outer periphery of the flapper 36 also includes a seal 46 to create fluid-tight engagement between the flapper 36 and the damper housing 32. In this regard, the flapper 36 may be molded within a sealing material, such as rubber, to form the seal 46 about the flapper 36.

Figure 12:
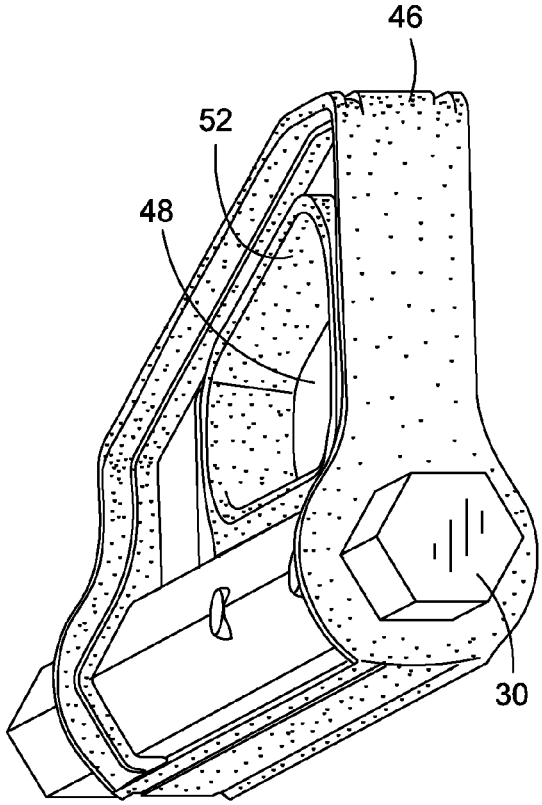
FIG. 12 is a lower perspective view of the flapper element encased in a seal.

The flapper 36 additionally includes an opening 48 (see FIGS. 11 and 12) extending therethrough to allow for fluid communication between the first and second chamber portions 44*a*, 44*b*. The opening 48 may be collectively formed by separate openings formed within each of the flapper bodies 38, 40 which become aligned when the bodies 38, 40 are connected to each other.

Figure 13:
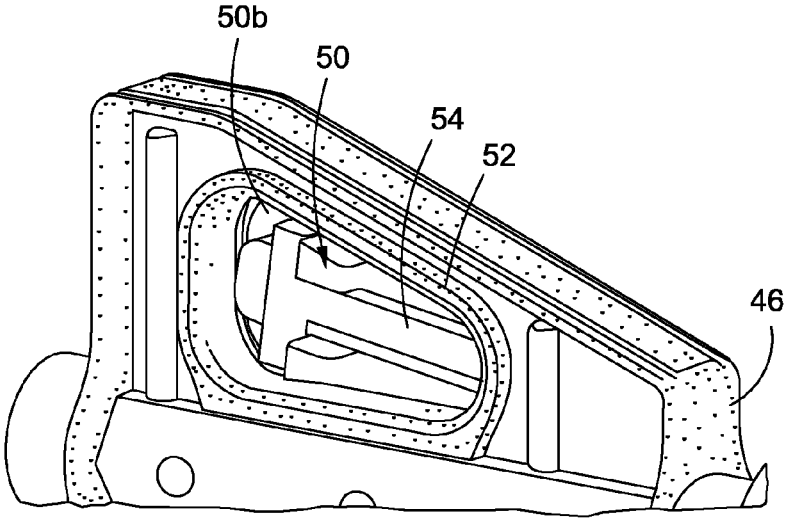
FIG. 13 is a partial upper perspective view of the flapper element and a seal.

Referring now to FIG. 13, a valve 50 may be connected to the flapper 36 to control fluid communication through the opening 48 between the first and second chamber portions 44*a*, 44*b*. In this regard, the valve 50 is moveable relative to the flapper 36 between an open position, wherein fluid may flow through the opening 48 between the first and second chamber portions 44*a*, 44*b*, and a closed position wherein the valve 50 effectively closes the opening 48 to substantially restrict or prevent fluid from communication between the first and second chamber portions 44*a*, 44*b* through the opening 48.

In the embodiment depicted in the drawings, the valve 50 includes a first valve body 50*a* and a second valve body 50*b* disposed on opposed sides of the flapper 36. The first valve body 50*a* is disposed adjacent the first flapper body 38, while the second valve body 50*b* is disposed adjacent the second flapper body 40. A valve seal 52 (see FIGS. 12 and 13) is disposed within the opening 48 and the valve bodies 50*a*, 50*b* engage with the valve seal 52 when they are in the closed position to prevent fluid communication through the opening 48.

FIG. 13 only shows the second valve body 50*b* to illustrate the inside of the valve 50, although it is understood that in a preferred embodiment, the valve 50 includes both first and second valve bodies 50*a*, 50*b*, as shown in FIGS. 8-10.

According to one embodiment, the valve bodies 50*a*, 50*b* are independently moveable and are biased toward the open position. The valve 50 may include a pair of springs 54 connected to respective ones of the valve bodies 50*a*, 50*b* to apply the biasing force to the valve bodies 50*a*, 50*b* to bias them toward the open position.

The inner chamber 34 of each damping mechanism 28 is filled with a damping fluid, which may be a liquid or gas. Along these lines, the damper cap 35 may include an opening 37 through which the damping fluid may be inserted into the inner chamber 34. A plug 39 and seal 41 may be used to fluidly close the opening 37 once the fluid is inserted within the inner chamber 34. The plug 39 may define external threads which cooperate with internal threads formed within the opening 37 to effectuate engagement between the plug 39 and the damper cap 35. Along these lines, the engagement between the plug 39 and damper cap 35 must also be tight enough to maintain the fluid seal and to withstand the hydraulic forces discussed in more detail below. In general, the movement of the flapper 36 within the inner chamber 34 creates a hydraulic force within the inner chamber 34, which is critical to the function of restricting sudden movements of the helmet 12, while allowing slow and safe movements of the helmet 12.

Referring now specifically to FIGS. 8-10, the movement of the flapper 36 within the damper housing 32 will be described. As the flapper 36 moves within the damper housing 32, the size of the first and second chamber portions 44*a*, 44*b* varies. For instance, when the flapper 36 moves in the direction identified by arrow 56 in FIG. 9, the size of the first chamber portion 44*a* decreases and the size of the second chamber portion 44*b* increases. Thus, the fluid flows from the first chamber portion 44*a* to the second chamber portion 44*b* when the flapper 36 moves in direction 56. Conversely, when the flapper 36 moves in the direction identified by arrow 58 in FIG. 10, the fluid flows from the second chamber portion 44*b* to the first chamber portion 44*a*.

However, in order for the fluid communication between the first and second chamber portions 44*a*, 44*b* to occur, the first and second valve bodies 50*a*, 50*b* must both be in the open position. If one of the first and second valve bodies 50*a*, 50*b* moves toward the closed position, fluid cannot flow between the first and second chamber portions 44*a*, 44*b*, which effectively locks the flapper 36 in place. When the flapper 36 is locked in place, movement of the helmet 12 is restricted to protect against dangerously quick movements.

As indicated above, both valve bodies 50*a*, 50*b* are biased toward an open position. Thus, in order for one of the valve bodies 50*a*, 50*b* to move toward the closed position, a force must be applied to one of the valve bodies 50*a*, 50*b*, which overcomes the biasing force and causes the valve body 50*a*, 50*b* to move to the closed position. Thus, the biasing forces applied to the valve bodies 50*a*, 50*b* define the "acceleration threshold" which must be overcome in order to "lock" the suspension system 10. If one of the biasing forces is not overcome, then the acceleration threshold has not been met (i.e., the motion of the user is safe). However, if the movement of the user's head causes the biasing force to be overcome (as described below), then the acceleration threshold has been exceeded, and the system 10 effectively restricts further movement of the user's head.

FIG. 9 shows the first valve body 50*a* in the closed position and the second valve body 50*b* in the open position. In the configuration shown in FIG. 9, the flapper 36 is being urged quickly in a first direction 56, which creates a hydraulic pressure in the first chamber portion 44*a* that is greater than the biasing force urging the first valve body 50*a* toward the open position, which causes the first valve body 50*a* to move into the closed position. In this regard, the hydraulic pressure exceeds the acceleration threshold. Therefore, fluid communication between the first and second chamber portions 44*a*, 44*b* is substantially restricted, thereby "locking" the flapper 36 in place until the hydraulic force is reduced to a point below the acceleration threshold which allows the first valve body 50*a* to move from the closed position toward the open position to effectuate fluid communication between the first and second chamber portions 44*a*, 44*b*.

Referring now to FIG. 10, the flapper 36 is being urged in a second direction 58 which generates a hydraulic force in the second chamber portion 44*b*, which is greater in magnitude than the biasing force applied to the second valve body 50*b* (i.e., greater than the acceleration threshold). Therefore, the hydraulic force causes the second valve body 50*b* to move into the closed position to restrict fluid flow from the second chamber portion 44*b* to the first chamber portion 44*a* to effectively "lock" the flapper 36 in place. The flapper 36 remains locked until the hydraulic force created by the flapper 36 decreases below the acceleration threshold to allow the second valve body 50*b* to move from the closed position toward the open position, which thereby allows fluid to flow from the second chamber portion 44*b* to the first chamber portion 44*a*.

Thus, in the exemplary embodiment, the acceleration threshold is directly correlated to the biasing force created by the springs 54 connected to the valve bodies 50*a*, 50*b* and to the hydraulic pressure created by the fluid within the damper 28. In this regard, the exemplary embodiment is a hydraulic-type regulation system. However, it is contemplated that other regulation systems may be implemented into the suspension system 10 without departing from the spirit and scope of the present invention. For instance, the system may by an electro-mechanical regulation system, which may employ a series of pressure sensors and mechanical suspension devices, which may be "locked" if the pressure sensors detect movement of the helmet above or below the acceleration threshold.

It is also contemplated that the acceleration threshold may be adjusted or modified if desired by the user. For instance, with regard to the exemplary embodiment, the acceleration threshold may be adjusted by modifying the biasing force applied by the spring 54. For instance, a damping mechanism 28 having a stronger spring 54 may be swapped out for a damping mechanism 28 having a weaker spring 54 in order to increase the acceleration threshold. Furthermore, with regard to the electro-mechanical regulation system mentioned above, the acceleration threshold may be programmed into the unit, such that the mechanical suspension devices may lock up only in response to a higher force.

Referring now back to FIG. 7, the movement of the flapper 36 is correlated to the movement of the helmet 12 via the interconnection of the flapper 36 to the helmet 12. According to one embodiment, the flapper is connected to the helmet 12 via the shaft 30, a coupler 60 and a screw 62 which connects the coupler 60 to the first arm 20. The shaft 30 is sized and configured to seat within a recess 64 formed within the coupler 60. An adhesive may be disposed within the recess to enhance the engagement between the coupler 60 and the shaft 30. Furthermore, the shaft 30 and recess 64 may be sized to enhance engagement therebetween, particularly in view of the rotational forces applied to the shaft 30 and recess 64. Along these lines, the exemplary shaft 30 and recess 64 define complimentary hexagonal configurations, which facilitate the transfer of rotational force between the shaft 30 and coupler 60.

The coupler 60 is additionally secured to the first arm 20 by inserting an end portion 66 of the coupler 60 through an opening 68 formed within the first arm 20. In the exemplary embodiment shown in FIG. 7, the end portion 66 and the opening 68 define complimentary quadrangular configurations, which facilitate communication of rotational forces between the first arm 20 and the coupler 60. Furthermore, the screw 62 further connects the coupler 60 to the first arm 20. Along theses lines, the screw 62 includes a head portion 70 having a recess 72 formed therein that is sized and configured to be complimentary to the end portion 66 of the coupler 60. In this regard, the end portion 66 is at least partially received within the recess 72. In addition, the end portion 66 includes an internally threaded aperture (not shown) which engages with the externally threaded shaft 74 to tighten the screw 62 to the coupler 60.

Referring now back to FIGS. 1 and 2, it is contemplated that the helmet suspension system 10 may include a plurality of damper assemblies 27, each having a damping mechanism 28, arm 20 and track insert 18. By having a plurality of assemblies 27, it is contemplated that the helmet 12 may be effectively "locked" (i.e., movement of the helmet relative to the damper assemblies 27 is substantially restricted). If only one damper assembly 27 is used, it may be possible for the helmet 12 to pivot or move about the track insert 18 when the damping mechanism 28 is locked. Thus, by employing a plurality of damper assemblies 27, movement of the helmet 12 is effectively restricted when the damper assemblies 27 are locked.

In the exemplary embodiments depicted in FIGS. 2 and 3, the helmet suspension system 10 includes four damper assemblies 27. Each damper assembly 27 includes a track insert 18 disposed within the track channel 16 and a respective arm 20 connected to the track insert 18. Each damper assembly 27 further includes a damping mechanism 28, as described in more detail above, connected to a respective arm 20.

According to one embodiment, a pair of damping mechanisms 28 are connected to a common base member 76. The base member 76 may be mounted to a shoulder pad of a driver suit, or to a surface of the vehicle. For instance, in auto racing, the cars may be outfitted with protective structures near the head, neck or shoulders of the driver to which the base member 76 may be mounted. If the suspension system 12 is being used in connection with a football helmet or hockey helmet, the base member 76 may be mounted to a shoulder pad or other protective article worn by the wearer.

Each damping mechanism 28 may include a mounting aperture 78 through which a mechanical fastener 80, such as a screw, rivet, or the like, may be inserted. The mechanical fastener 80 may also be inserted through an aperture formed within the base member 76 for connecting the base member 76 to the damping mechanism 28. A double-washer 82 may also be used to join a pair of damping mechanisms 28. More specifically, the double-washer 82 may include a pair of apertures which are aligned with the mounting apertures 78 of a pair of damping mechanisms 28 such that the mechanical fasteners 80 may be advanced through the double-washer 82 before insertion into the mounting apertures 78.

In use, the suspension system 10 may be used to protect the helmet 12 from rapid acceleration/deceleration.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combinations described herein. Thus, the scope of the claims is not to be limited by the illustrated embodiments.

What is claimed is:

1. A helmet suspension system configured for use with a helmet to mitigate large accelerations of the helmet relative to the wearer's body, the helmet suspension system comprising:

a guide member carried by the helmet;

a first member moveable relative the guide member;

a first arm having a first end portion and a second end portion, the first end portion being connected to the first member, the first arm being moveable relative to the guide member as the first member moves within the guide member; and a first damper moveably connected to the second end portion of the first arm, the first damper being configured to define an acceleration threshold of the second end portion relative to the first damper and to allow movement of the first arm relative to the first damper when the motion of the first arm is below the acceleration threshold and restrict movement of the first arm relative to the first damper when the motion is above the acceleration threshold;

a second member moveable relative the guide member;

a second arm having a first end portion and a second end portion, the first end portion being connected to the second member, the second arm being moveable relative to the guide member as the second member moves within the guide member; and a second damper moveably connected to the second end portion of the second arm, the second damper being configured to define an acceleration threshold of the second end portion relative to the second damper and to allow movement of the second arm relative to the second damper when the motion of the second arm is below the acceleration threshold and restrict movement of the second arm relative to the second damper when the motion is above the acceleration threshold; and a third member moveable relative the guide member;

a third arm portion having a first end portion and a second end portion, the first end portion being connected to the third member, the third arm being moveable relative to the guide member as the third member moves within the guide member;

a third damper moveably connected to the second end portion of the third arm, the third damper being configured to define an acceleration threshold of the second end portion relative to the third damper and to allow movement of the third arm relative to the third damper when the motion of the third arm is below the acceleration threshold and restrict movement of the third arm relative to the third damper when the motion is above the acceleration threshold;

a fourth member moveable relative the guide member;

a fourth arm having a first end portion and a second end portion, the first end portion being connected to the fourth member, the fourth arm being moveable relative to the guide member as the fourth member moves within the guide member; and a fourth damper moveably connected to the second end portion of the fourth arm, the fourth damper being configured to define an acceleration threshold of the second end portion relative to the fourth damper and to allow movement of the fourth arm relative to the fourth damper when the motion of the fourth arm is below the acceleration threshold and restrict movement of the fourth arm relative to the fourth damper when the motion is above the acceleration threshold.

2. The helmet suspension system recited in claim 1, wherein the guide member is configured to define a closed loop.

3. The helmet suspension system recited in claim 1, wherein the first member is a roller configured to roll within the guide member.

4. The helmet suspension system recited in claim 3, wherein the roller is formed from a rubber material.

5. The helmet suspension system recited in claim 1, further comprising a stopper disposed within the guide member and configured to limit movement of the first insert within the guide member.

6. The helmet suspension system recited in claim 1, further comprising damper base connected to the first damper and the second damper.

7. The helmet suspension system recited in claim 1, wherein the first damper includes:

a damper housing defining an inner chamber;

a flapper disposed within and moveable within the inner chamber, the flapper dividing the inner chamber into a first chamber portion and a second chamber portion, the flapper further defining a flapper opening through which the first and second chamber portions are fluidly connectable; and a valve connected to the flapper to control fluid communication between the first and second chamber portions via the flapper opening.

8. The helmet suspension system recited in claim 7, wherein the valve is moveable relative to the flapper between an open position wherein the valve is positioned to allow fluid flow through the flapper opening between the first and second chambers and a closed position wherein the valve substantially blocks fluid flow through the flapper opening between the first and second chamber portions.

9. The helmet suspension system recited in claim 8, wherein the valve is biased toward the open position.

* * * * *